US006364673B1

(12) United States Patent
Lee

(10) Patent No.: US 6,364,673 B1
(45) Date of Patent: Apr. 2, 2002

(54) ELECTRICAL OUTLET COVER

(76) Inventor: Han Young Lee, 2430 Richoak Dr., Garland, TX (US) 75044

( * ) Notice: Subject to any disclaimer, the term of this patent is extended or adjusted under 35 U.S.C. 154(b) by 0 days.

(21) Appl. No.: 09/584,121

(22) Filed: May 31, 2000

(51) Int. Cl.[7] ..... H01R 13/44

(52) U.S. Cl. ..... 439/139; 439/143; 439/140; 174/67

(58) Field of Search ..... 439/139, 142, 439/143, 145; 174/67, 55–56; 220/242

(56) References Cited

U.S. PATENT DOCUMENTS 5,096,432 A * 3/1992 Cullen et al. ..... 439/139

* cited by examiner

*Primary Examiner*—Renee Luebke
*Assistant Examiner*—Felix O. Figueroa
(74) *Attorney, Agent, or Firm*—Crutsinger & Booth

(57) ABSTRACT

An electrical outlet cover having a pair of floating socket covers which are resiliently urged toward a first position wherein holes in the floating socket covers are not aligned with holes in the electrical outlet. The floating socket cover must be rotated from the first position to a second position wherein holes in the socket cover are aligned with holes in the cover and then pushed toward the socket for moving prongs on the plug into holes in the socket. While prongs on the plug are moving into holes on the socket the prongs are covered by the floating socket covers to prevent electrical shock resulting from touching prongs of a plug that is partially plugged into the electrical socket.

18 Claims, 2 Drawing Sheets

ELECTRICAL OUTLET COVER

TECHNICAL FIELD

An electrical outlet cover having a cover plate which must be rotated for aligning prongs on a plug with holes in an outlet socket and then pushed inwardly for moving prongs on the plug into holes in the electrical outlet socket.

BACKGROUND OF INVENTION

U.S. Pat. No. 5,944,542 discloses a device for shielding prongs on an electric plug as the plug is being pushed into or removed from an electrical outlet. The device includes a hollow housing, a face plate having holes for receiving prongs on an electric plug and a compression spring. The face plate is movably mounted within the housing, with the compression spring extending between the face plate and the housing such that the housing extends forward of the face plate and toward an electrical outlet when the adapter is mounted over the electrical outlet. As the prongs on the electrical plug are inserted into the socket in the electrical outlet, the housing extends around the prongs, covering the prongs. While this apparatus protects against engaging prongs of the plug when it is partially plugged into the outlet, it does not prevent insertion of metallic objects, such as paper clips, into the socket by children.

A variety of socket covers and plugs have been devised to make it difficult for children to insert fingers or other objects into unused electrical outlets. U.S. Pat. Nos. 5,011,419 and 5,813,873 disclose slidable plates having slots for the prongs on a plug which are biased to a position wherein the slots on the slidable cover are not aligned with openings in the outlet. For inserting a plug into an electrical outlet, the slidable cover is moved to a position wherein the slots are aligned with openings in the electrical outlet so that the prongs can move through the slots in the slidable cover into the electrical outlet.

A swivel outlet cover is also commercially available which replaces existing outlet plates. A spring-loaded swivel cover having holes formed therein which conform to configuration of an electrical outlet socket can be rotated for aligning holes in the cover with the holes in the socket for insertion of a plug. The cover swivels to a closed position preventing access to the holes in the electrical outlet socket when the outlet is not in use.

The swivel outlet cover and the slidable covers aid in preventing children from putting fingers or small objects into the electrical outlet socket. However, when a plug is partially inserted into the outlet socket, portions of the prongs are exposed which may result in electrical shock if contacted.

Other protective devices include covers that fit over unused electrical outlets which can be removed by squeezing and lifting the cover from the outlet. Outlet plugs arc also available which fit into standard electrical outlets to help protect children from electrical shock.

A long felt need exists for an electrical outlet cover which serves a dual function of preventing insertion of small objects into an unused electrical socket and protecting against engagement of prongs or blades on an electric plug which are partially inserted into the socket.

SUMMARY OF INVENTION

The electrical outlet cover disclosed herein is configured to protect against any electrical shock from common electrical outlets. The electrical outlet cover includes a cover plate, a pair of floating socket covers, a pair of springs and a back mounting plate. When assembled, the floating socket covers having slots formed therein to receive prongs on a plug are rotated about 45° and are positioned about ⅓ of an inch away from the back plate which is mounted over a conventional electrical outlet socket. The floating socket covers cannot be pushed inwardly for insertion of prongs on a plug into the socket until they have been rotated to a position wherein openings in the floating cover are aligned with openings in the outlet socket.

The springs are mounted to apply torque and compressive forces to the floating covers such that the covers must be rotated and then moved inwardly toward the electrical outlet for inserting prongs on a plug into the electrical outlet. The prongs are covered by the floating covers to prevent inadvertent contact with the prongs when the prongs are partially inserted into the electrical outlet socket.

DESCRIPTION OF THE DRAWINGS

Drawings of a preferred embodiment of the invention are annexed hereto, so that the invention may be better and more fully understood, in which.

Numeral references are employed to designate like parts throughout the various figures of the drawing.

DESCRIPTION OF A PREFERRED EMBODIMENT

Figure 1:
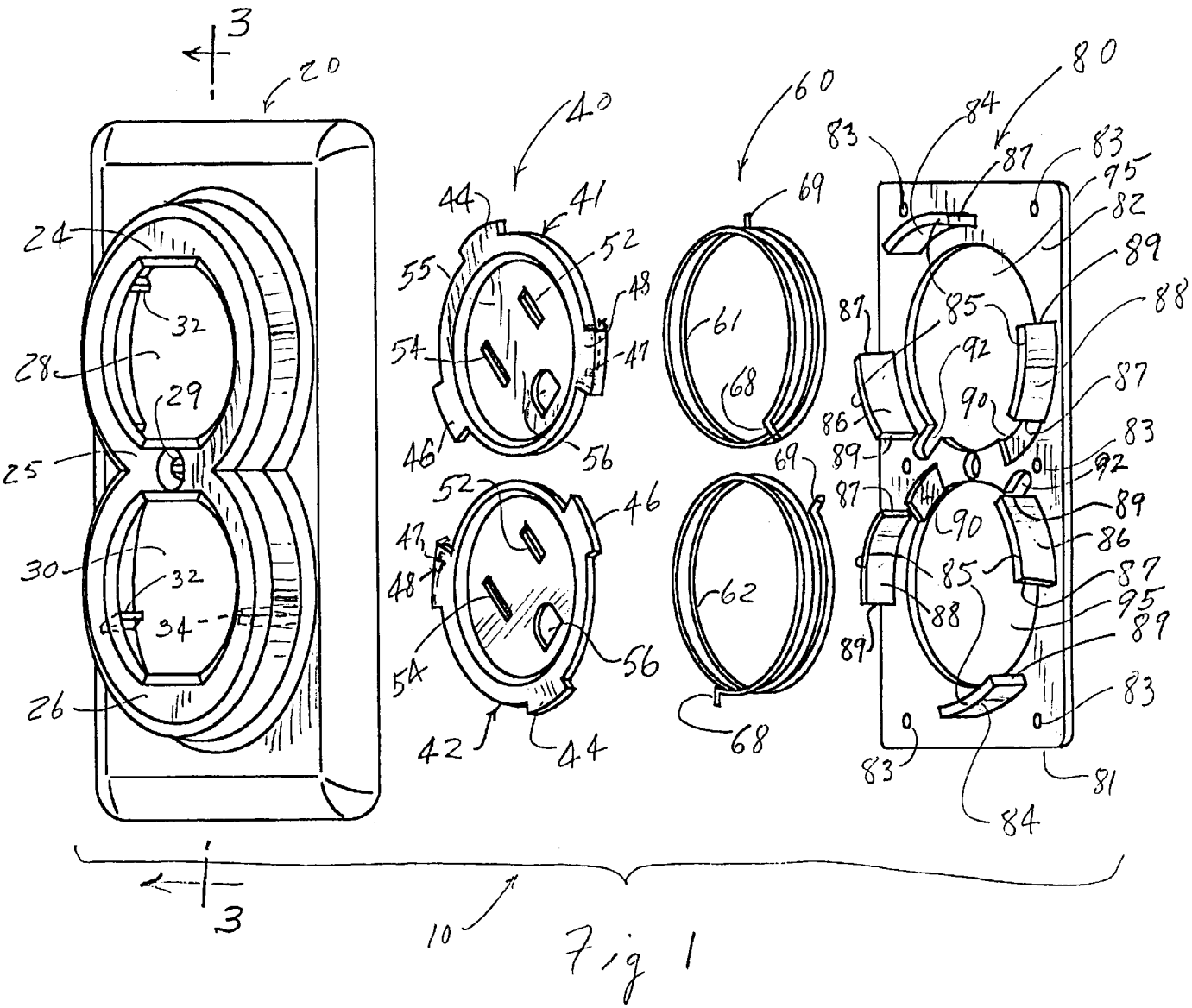
FIG. 1 is an exploded perspective view illustrating a cover plate, a pair of floating socket covers, a pair of springs and a back mounting plate.
Figure 2:
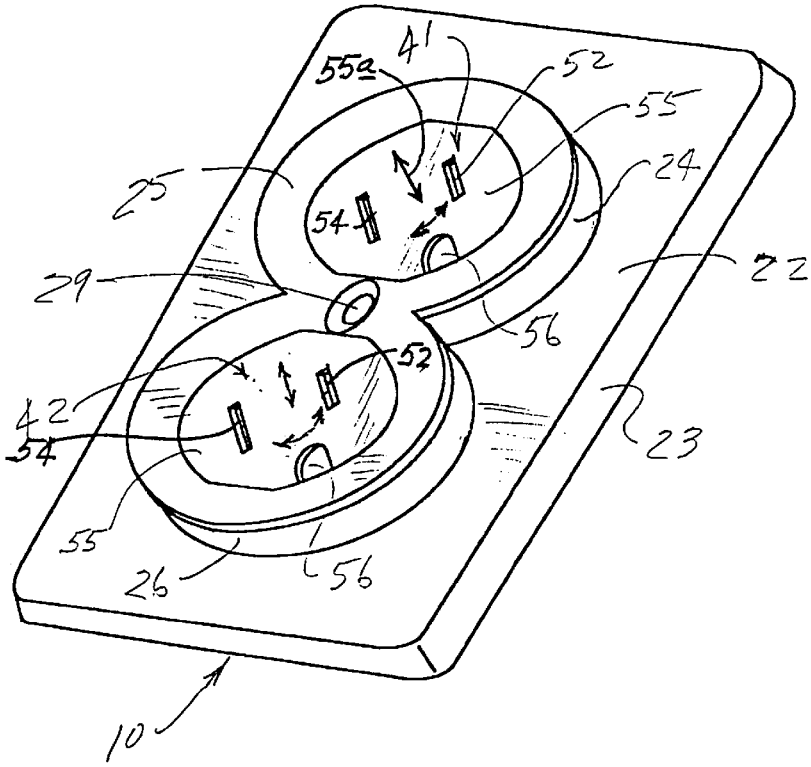
FIG. 2 is a perspective view of an assembled electrical outlet cover.

Referring to FIGS. 1 and 2 of the drawing, the numeral 10 generally designates an electrical outlet cover embodying the invention. The electrical outlet cover 10 generally comprises a cover plate 20, a floating socket cover assembly 40, a spring assembly 60 for exerting torque and compressional forces, and a back mounting plate 80.

Figure 3:
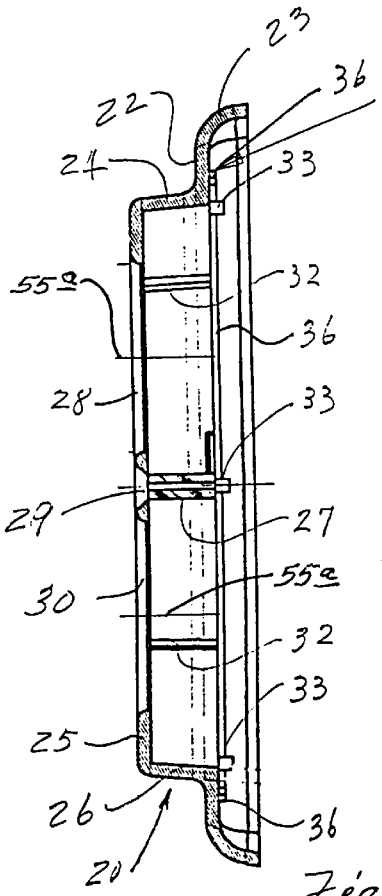
FIG. 3 is a cross-sectional view taken along line 3—3 of FIG. 1.

Referring to FIGS. 1 and 3 of the drawing, cover plate 20 is preferably of unitary design and may be molded from a suitable plastic material. Cover plate 20 has a generally planar body portion 22 with curved flanges 23 extending around the outer periphery thereof. Cups 24 and 26 are formed on body portion 22 and have generally cylindrical outer walls which extend from body portion 22 and terminate with a generally planar face plate 25 having openings 28 and 30 extending therethrough. Cups 24 and 26 intersect at opposite sides of a common central wall 27 having a screw hole 29 formed therein.

A pair of ribs 32 and 34 extend inwardly from cylindrical walls of cups 24 and 26 for forming stops to limit rotational movement of the floating disk assembly 40, as will be hereinafter more fully explained.

In the embodiment of the invention illustrated in FIG. 3 of the drawing, a plurality of locator pins 33 are formed on the lower surface of body portion 22 and a bead 36 extends around a generally rectangular-shaped area for receiving the outer periphery 81 of the body portion 82 of the back mounting plate 80, as will be hereinafter more fully explained.

The floating socket cover assembly 40 generally comprises socket covers 41 and 42 having a plurality of followers 44, 46 and 48 formed thereon. In the illustrated embodiment, socket covers 41 and 42 are generally disk shaped elements having a central recessed area bounded by a cylindrical outer wall and a circular face plate 55. Face plate 55 has slots 52 and 54 formed therein for receiving the blades of a polarized electric plug. It should be noted that slot 54 is slightly larger than slot 52 to accommodate the wide blade of a polarized plug. Face plate 55 is also provided with an opening 56 through which the ground prong of a three-prong plug extends.

Figure 4:
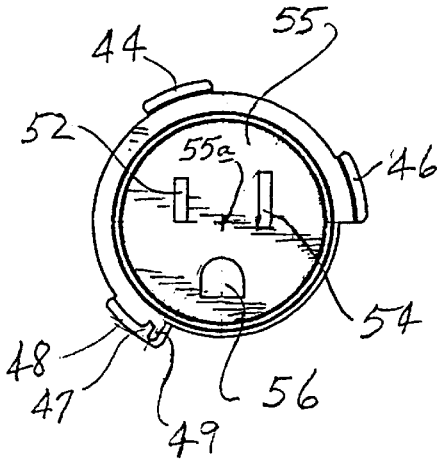
FIG. 4 is an elevational view of the rear of a floating socket cover.

As will be hereinafter more fully explained, followers 48 are a little thicker than followers 44 and 46 and as best illustrated in FIG. 4 of the drawing, a portion of each follower 48 is cut away to form a hook 47 and groove 49 for anchoring deflected end portions 68 of springs 61 or 62. It should be appreciated that ends of springs 61 and 62 may be captured in a hole or socket in followers 48 to prevent disengagement of the springs from the follower.

Floating cover plates 41 and 42 are of substantially identical design, except that the follower 48 on cover 41 is positioned slightly to the right of ground prong opening 56, as illustrated in FIG. 1 of the drawing, while follower 48 on cover 42 is positioned near the upper end of elongated slot 54.

Back mounting plate assembly 80 generally comprises a body portion 82 having a plurality of locator pin holes 83 formed therethrough configured to receive locator pins 33 on cover plate 20.

A plurality of cam lugs 84, 86 and 88 extend outwardly from body portion 82 and have cam surfaces 85 formed on outer ends thereof. Each of the cam lugs 84, 86 and 88 has an end surface 87 on one end and an end surface 89 on the opposite end.

Cut-out spaces 90 are formed to receive the thickened followers 48 on floating socket covers 41 and 42.

A pair of openings 92 extend outwardly from the periphery of openings 95 to permit visual inspection of springs 61 and 62 during the assembly process to assure that the apparatus is assembled properly.

When assembled, thickened follower 48 on floating socket cover 41 is positioned to ride along surface 85 on cam lug 88 when cover plate 41 is rotated until follower 48 drops off of the end of surface 85 adjacent end surface 87 on lug 88. Follower 44 moves along surface 85 on cam lug 84 and follower 46 moves along surface 85 on cam lug 86 of the upper unit as illustrated in FIG. 1 of the drawing.

The bottom floating socket cover 42 is positioned such that thickened lug 48 moves along surface 85 on the bottom cam lug 88 while follower 44 moves along surface 85 on cam lug 84 and follower 46 moves along surface 85 on cam lug 86.

Outwardly deflected end portion 68 on spring 61 engages spring hook 47 on socket cover 41 while the outwardly deflected portion 68 on spring 62 engages hook 47 on the lower socket cover 42. The outwardly deflected end portions 69 on the opposite ends of springs 61 and 62 are positioned in engagement with surfaces 89 on cam lug 86.

Ribs 32 and 34 are positioned to engage the edge of follower 46 on upper socket cover 41 and lug 44 on lower socket cover 42 for limiting rotational movement of the floating socket covers.

Springs 61 and 62 urge cover plates 41 and 42 away from mounting plate 80 to a position engaging the lower surface of face plate 25 when a plug is disengaged from the electrical outlet socket. Springs 61 and 62 also apply torque to floating socket covers 41 and 42 urging the covers parallel to surfaces 85 to the position illustrated in FIGS. 1 and 2 of the drawing.

When floating socket covers 41 and 42 are in the first position illustrated in FIGS. 1 and 2 of the drawings, followers 44, 46 and 48 engage surfaces 85 on cam lugs 84, 86 and 88, respectively. Thus, socket covers 41 and 42 can be rotated about axis 55*a* in a clockwise direction, as viewed in FIGS. 1 and 2 of the drawing, to a second position wherein slots 52 and 54 are aligned with slots in the electrical outlet socket (not shown). When slots 52 and 54 are aligned with slots in the electrical outlet socket, followers 44, 46 and 48 clear the ends of surfaces 85 on cam lugs 84, 86 and 88, allowing covers 41 and 42 to move parallel to surfaces 87 and axis 55*a* to a third position as prongs on the plug move into the electrical outlet socket.

Springs 61 and 62 do not exert sufficient force to move an electric plug out of the outlet socket. However, the springs bias floating plates 41 and 42 outwardly away from back mount plate 80 toward the second position and when the plug is removed from the socket and allowed to move outwardly along surfaces 87, springs 61 and 62 will urge cover plates 41 and 42 in a counter-clockwise direction, as viewed in FIG. 1 to the first illustrated position.

From the foregoing it should be readily apparent that floating socket covers 41 and 42 are mounted to prevent insertion of foreign objects into a protected electrical outlet socket without rotation of the socket covers to the second position wherein followers 44, 46 and 48 clear edges of cam lugs 84, 86 and 88. It should also be readily apparent that prongs on the electric plug are not accessible from outside of cups 24 and 26 when floating socket covers 41 and 42 are moving between the second position and the third position adjacent mounting plate 80 for plugging the prongs on a plug into an electrical outlet socket.

While springs 61 and 62 apply both compression force and torque to floating socket covers 41 and 42, it should be readily apparent that multiple springs or other resilient materials may be employed for biasing the floating socket covers 41 and 42 toward the desired positions.

Terms such as "left," "right," "horizontal," "vertical," "up," "down," "clockwise" and "counterclockwise" when used in reference to the drawings, generally refer to the orientation of the parts in the illustrated embodiment and not necessarily during use. These terms used herein are meant only to refer to relative positions and/or orientations, for convenience, and are not to be understood to be in any manner otherwise limiting.

It should be appreciated that other and further embodiments of the invention may be devised without departing from the basic concept thereof.

Having described the invention, I claim:

1. An electrical outlet cover comprising:

a mounting plate;

a cover plate having a hollow cup;

a socket cover in said hollow cup said socket cover having slots for receiving prongs on a plug;

a cam lug on said mounting plate preventing movement of said socket cover toward the socket until the cover has moved to a position wherein said slots in the cover are aligned with slots in the socket;

stop means in said cup configured to limit movement of said socket cover between a first position and a second position; and resilient means in said cup engaging said socket cover for applying torque for urging said socket cover toward said first position and applying linear force urging said socket cover away from said mounting plate toward said second position.

2. An electrical outlet cover according to claim 1, said mounting plate having a pair of openings configured for receiving sockets of an electrical outlet.

3. An electrical outlet cover according to claim 2, said cover plate having flanges extending around the outer periphery thereof for receiving the outer periphery of the mounting plate; and a face plate having openings extending therethrough, said face plate being spaced from said mounting plate.

4. An electrical outlet cover according to claim 1, said mounting plate comprising:

a body portion having a plurality of cam lugs formed thereon for engaging said socket cover to control movement of said socket cover relative to said mounting plate.

5. An electrical outlet cover according to claim 4, said socket cover comprising:

a disk having a plurality of followers thereon, said followers being configured to move relative to said cam lugs.

6. An electrical outlet cover according to claim 5, said resilient means comprising:

a coil spring configured for applying torque and compression forces to said socket cover.

7. An electrical outlet cover according to claim 4, each of said cam lugs having first surfaces lying in a first plane and second cam surfaces extending generally perpendicular to said first plane.

8. A method for manipulating a socket cover secured over an electrical outlet socket for inserting prongs on a plug into openings in an electrical outlet socket comprising the steps of:

urging a socket cover having slots to a first position wherein said slots in said socket cover are not aligned with openings in the electrical outlet socket;

preventing movement of the socket cover toward the socket until the cover has moved to a position wherein slots in the cover are aligned with slots in the socket;

moving the socket cover in a first plane to a second position wherein slots in the cover are aligned with slots in the socket to gain access to openings in the electrical outlet socket; and moving the socket cover from the second position in a direction perpendicular to the first plane to a third position for inserting prongs on a plug into openings in the electrical outlet socket.

9. The method of claim 1 wherein the step of urging a socket cover to a first position comprises:

applying torque to said socket cover for rotating the socket cover about a longitudinal axis.

10. The method according to claim 9, the step of moving the socket cover in a first plane to a second position comprising:

rotating the socket cover about the longitudinal axis from said first position to said second position.

11. A method according to claim 10, the step of moving the socket cover from the second position in a direction perpendicular to the first plane to a third position comprising:

moving the socket cover parallel to the longitudinal axis.

12. A method according to claim 11 with the additional step of:

urging said socket cover from said third position toward said second position.

13. A method according to claim 12 wherein the step of urging a socket cover to a first position and the step of urging the socket cover toward the second position comprise:

applying torque and compression spring forces to the socket cover.

14. A method according to claim 1 wherein the step of urging a socket cover to a first position comprises:

resiliently biasing the socket cover by a spring.

15. A method according to claim 1, the step of moving the socket cover in a first plane to a second position comprising:

moving the socket cover generally parallel to a first cam surface on a cam lug for disengaging the socket cover from the first cam surface.

16. A method according to claim 15, the step of moving the socket cover from the second position in a direction perpendicular to the first plane to a third position comprising the step of:

moving the socket cover generally parallel to a second cam surface.

17. A method according to claim 15 wherein the first cam surface is positioned to prevent movement of the socket cover in a direction perpendicular to said first plane until the socket cover is moved to said second position.

18. A method for preventing unauthorized insertion of objects into an electrical outlet comprising the steps of:

positioning a socket cover having slots for receiving prongs on a plug adjacent to an electrical outlet;

resiliently urging said socket cover to a position wherein said slots in said cover are not in alignment with openings in an outlet socket;

preventing movement of the socket cover toward the socket until the cover has moved to a position wherein slots in the cover are aligned with slots in the socket; and resiliently urging the socket cover away from the outlet socket such that said cover moves with prongs on a plug to prevent access to the prongs when the prongs are partially inserted into openings in the outlet socket.

* * * * *